US010741349B2

(12) United States Patent
Minowa et al.

(10) Patent No.: US 10,741,349 B2
(45) Date of Patent: Aug. 11, 2020

(54) ELECTROMAGNETIC RELAY

(71) Applicant: OMRON Corporation, Kyoto (JP)

(72) Inventors: Ryota Minowa, Kumamoto (JP); Shingo Mori, Kumamoto (JP); Toshiyuki Kakimoto, Shiga (JP); Kazuhiro Ikemoto, Kumamoto (JP)

(73) Assignee: Omron Corporation, Kyoto (JP)

( * ) Notice: Subject to any disclaimer, the term of this patent is extended or adjusted under 35 U.S.C. 154(b) by 47 days.

(21) Appl. No.: 16/309,778

(22) PCT Filed: Jun. 22, 2017

(86) PCT No.: PCT/JP2017/023025

§ 371 (c)(1),
(2) Date: Dec. 13, 2018

(87) PCT Pub. No.: WO2018/020916

PCT Pub. Date: Feb. 1, 2018

(65) Prior Publication Data

US 2019/0311871 A1 Oct. 10, 2019

(30) Foreign Application Priority Data

Jul. 29, 2016 (JP) ..... 2016-150288

(51) Int. Cl.
*H01H 9/00* (2006.01)
*H01H 50/42* (2006.01)
(Continued)

(52) U.S. Cl.
CPC ..... *H01H 50/42* (2013.01); *H01H 1/64* (2013.01); *H01H 50/18* (2013.01); *H01H 50/54* (2013.01);
(Continued)

(58) Field of Classification Search
CPC ..... H01H 50/18; H01H 50/04; H01H 50/38; H01H 50/42; H01H 50/54; H01H 50/443; H01H 9/44; H01H 9/443; H01H 51/29
(Continued)

(56) References Cited

U.S. PATENT DOCUMENTS 2,261,887 A * 11/1941 Menzel ..... H01H 51/20 335/106
5,245,881 A * 9/1993 Rometsch ..... F02N 15/067 335/131
(Continued)

FOREIGN PATENT DOCUMENTS

CN 102804316 A 11/2012
JP S58-71918 U 5/1983
(Continued)

OTHER PUBLICATIONS

Office Action in counterpart Chinese Patent Application No. 201780035483.0 dated May 29, 2019 (16 pages).
(Continued)

*Primary Examiner* — Shawki S Ismail
*Assistant Examiner* — Lisa N Homza
(74) *Attorney, Agent, or Firm* — Osha Liang LLP

(57) ABSTRACT

An electromagnetic relay includes a box-shaped insulating housing in which a closed space is formed, a pair of fixed terminals fixed to the housing electrically independently of each other and each having a fixed contact placement surface in the closed space, a plate-shaped conductive movable contactor that is provided in the closed space, has a first surface facing the fixed contact placement surfaces of the pair of fixed terminals, and is movably disposed such that the first surface approaches and separates from the fixed contact placement surfaces of the pair of fixed terminals, a pair of fixed contacts respectively provided on the fixed
(Continued)

contact placement surfaces of the pair of fixed terminals, and a pair of movable contacts that is respectively provided on the first surface of the movable contactor and respectively face the pair of fixed contacts.

7 Claims, 5 Drawing Sheets

(51) Int. Cl.
*H01H 50/18* (2006.01)
*H01H 50/54* (2006.01)
*H01H 1/64* (2006.01)
*H01H 50/64* (2006.01)
*H01H 50/36* (2006.01)

(52) U.S. Cl.
CPC ..... *H01H 50/546* (2013.01); *H01H 50/641* (2013.01); *H01H 2050/362* (2013.01)

(58) Field of Classification Search
USPC ..... 335/177
See application file for complete search history.

(56) References Cited

U.S. PATENT DOCUMENTS 5,481,236 A * 1/1996 Ruehle ..... H01H 51/065 335/126
5,892,194 A * 4/1999 Uotome ..... H01H 1/34 218/68
6,911,884 B2 * 6/2005 Uotome ..... H01H 47/06 335/132
7,911,301 B2 * 3/2011 Yano ..... H01H 9/443 335/131
8,674,796 B2 * 3/2014 Ito ..... H01H 1/20 335/126
2010/0289604 A1 * 11/2010 Kojima ..... H02H 9/001 335/133
2013/0057369 A1 * 3/2013 Yano ..... H01H 1/36 335/156
2013/0106542 A1 5/2013 Yano et al.
2013/0240495 A1 * 9/2013 Yano ..... H01H 9/36 219/123
2015/0022291 A1 * 1/2015 Kashimura ..... H01H 50/546 335/131
2015/0213982 A1 * 7/2015 Lim ..... H01H 1/54 335/185
2016/0093458 A1 * 3/2016 An ..... H01H 50/18 335/136
2017/0069452 A1 * 3/2017 Hiroki ..... H01H 9/443
2019/0013171 A1 * 1/2019 Minowa ..... H01H 50/44
2019/0035585 A1 * 1/2019 Minowa ..... H01H 50/42
2019/0122844 A1 * 4/2019 Minowa ..... H01H 50/02
2019/0131093 A1 * 5/2019 Minowa ..... H01H 50/645
2019/0131094 A1 * 5/2019 Minowa ..... H01H 50/443
2019/0131095 A1 * 5/2019 Minowa ..... H01H 1/502
2019/0131096 A1 * 5/2019 Minowa ..... H01H 50/641
2019/0131097 A1 * 5/2019 Minowa ..... H01H 50/04
2019/0148095 A1 * 5/2019 Minowa ..... H01H 50/42 335/185
2019/0304728 A1 * 10/2019 Minowa ..... H01H 50/58
2019/0304729 A1 * 10/2019 Minowa ..... H01H 50/14
2019/0311871 A1 * 10/2019 Minowa ..... H01H 50/546

FOREIGN PATENT DOCUMENTS

JP 2012-104356 A 5/2012
JP 5559662 B2 7/2014
WO 2011/115057 A1 9/2011

OTHER PUBLICATIONS

International Search Report issued in Application No. PCT/JP2017/023025, dated Sep. 26, 2017 (2 pages).
Written Opinion issued in International Application No. PCT/JP2017/023025, dated Sep. 26, 2017 (4 pages).

* cited by examiner

ELECTROMAGNETIC RELAY

BACKGROUND

Technical Field

The present invention relates to an electromagnetic relay.

Related Art

An electromagnetic relay disclosed in Patent Document 1 includes: a housing having a closed space therein; a pair of fixed terminals electrically fixed to the housing so as to be electrically independent of each other; and a plate-shaped movable contactor which is provided in the closed space, faces a pair of fixed terminals, and is movable so as to approach or separate from the pair of fixed terminals. A fixed contact is fixed to each of the tips, located in the closed space, of the pair of fixed terminals. A pair of movable contacts arranged so as to respectively face the pair of fixed contacts are fixed to the movable contactor.

In addition, the electromagnetic relay includes a first electromagnetic member electrically independently fixed to the pair of fixed terminals between the pair of fixed terminals of the housing, and a second electromagnetic member that faces one end of the movable contactor of the first electromagnetic member in the moving direction, and is fixed to the movable contactor so as not to come into contact with the first electromagnetic member. In this electromagnetic relay, when the pair of fixed contacts and the pair of movable contacts come in contact with each other and a current flows through the movable contactor, a magnetic flux passing through the first electromagnetic member and the second electromagnetic member is generated, and an electromagnetic attractive force acts between the first electromagnetic member and the second electromagnetic member.

Patent Document 1: Japanese Patent No. 5559662

SUMMARY

In the electromagnetic relay, an electromagnetic repulsive force is canceled out by the electromagnetic attractive force generated between the first electromagnetic member and the second electromagnetic member to ensure contact reliability between the fixed contact and the movable contact, the electromagnetic repulsive force being generated when the pair of fixed contacts and the pair of movable contacts come into contact with each other to allow a current to flow.

Meanwhile, at the time of opening and closing the pair of fixed contacts and the pair of movable contacts, the powder of the contact, melted by heat of arc, scatters (the scattered powder of the contact is hereinafter referred to as scattered powder) associated with the contact and separation of the pair of fixed contacts and the pair of movable contacts, the arc being generated between the pair of fixed contacts and the pair of movable contacts. When this scattered powder is accumulated between the pair of fixed terminals and the first electromagnetic member, a short-circuit path is formed between the pair of fixed terminals via the scattered powder since the scattered powder is conductive, thereby causing significant deterioration in insulating property of the electromagnetic relay.

Therefore, it is an object of the present invention to provide an electromagnetic relay capable of avoiding formation of a short-circuit path between a pair of fixed terminals due to a scattered powder and ensuring insulation.

An electromagnetic relay according to one or more embodiments of the present invention is an electromagnetic relay including: a box-shaped insulating housing in which a closed space is formed; a pair of fixed terminals fixed to the housing electrically independently of each other and each having a fixed contact placement surface in the closed space; a plate-shaped conductive movable contactor which is provided in the closed space, has a first surface facing the fixed contact placement surfaces of the pair of fixed terminals, and is movably disposed such that the first surface approaches and separates from the fixed contact placement surfaces of the pair of fixed terminals; a pair of fixed contacts respectively provided on the fixed contact placement surfaces of the pair of fixed terminals; a pair of movable contacts which respectively provided on the first surface of the movable contactor and which respectively face the pair of fixed contacts, respectively come into contact with the pair of fixed contacts with approach of the movable contactor to the pair of fixed terminals, and is disposed so as to respectively separate from the pair of fixed contacts with separation of the movable contactor from the pair of fixed terminals; a plurality of first electromagnetic members which are disposed electrically independently of each other, with a gap provided therebetween in a first direction that is an arrangement direction of the pair of fixed terminals, between the pair of fixed terminals in the housing, are fixed to the pair of fixed terminals in an electrically independent manner; and which extend in a second direction orthogonal to the first direction in a plan view seen along a moving direction of the movable contactor; and a second electromagnetic member which includes a pair of facing portions disposed so as to sandwich the movable contactor in the second direction and extending along the first direction, and a coupling portion fixed to a second surface on an opposite side of the movable contactor from the first surface and configured to couple the pair of facing portions on the second surface side, the second electromagnetic member being configured such that the pair of facing portions face respective one ends of the plurality of first electromagnetic members on the movable contactor side in the moving direction, and a gap is provided between the second electromagnetic member and the one ends of the plurality of first electromagnetic members when the pair of movable contacts respectively come into contact with the pair of fixed contacts.

According to the electromagnetic relay according to one or more embodiments of the present invention, with the plurality of first electromagnetic members provided, it is possible to avoid formation of a short-circuit path between a pair of fixed terminals due to a scattered powder and ensure the insulation between the pair of fixed terminals and the plurality of first electromagnetic members being disposed electrically independently of each other, with a gap provided therebetween in the arrangement direction of the pair of fixed terminals, between the pair of fixed terminals in the housing and being fixed to the pair of fixed terminals in an electrically independent manner.

DETAILED DESCRIPTION

Hereinafter, embodiments of the present invention will be described with reference to the accompanying drawings. In the following description, terms (e.g., terms including "upper", "lower", "right", "left", "side", and "end") indicating specific directions or positions are used as necessary, but the use of these terms is for facilitating understanding of the invention with reference to the drawings, and the technical scope of the present invention is not limited by the meaning of these terms. The following description is merely exemplary in nature and not intended to limit the present invention, its application, or its usage. Further, the drawings are schematic, and ratios of dimensions or the like do not necessarily agree with actual ones. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
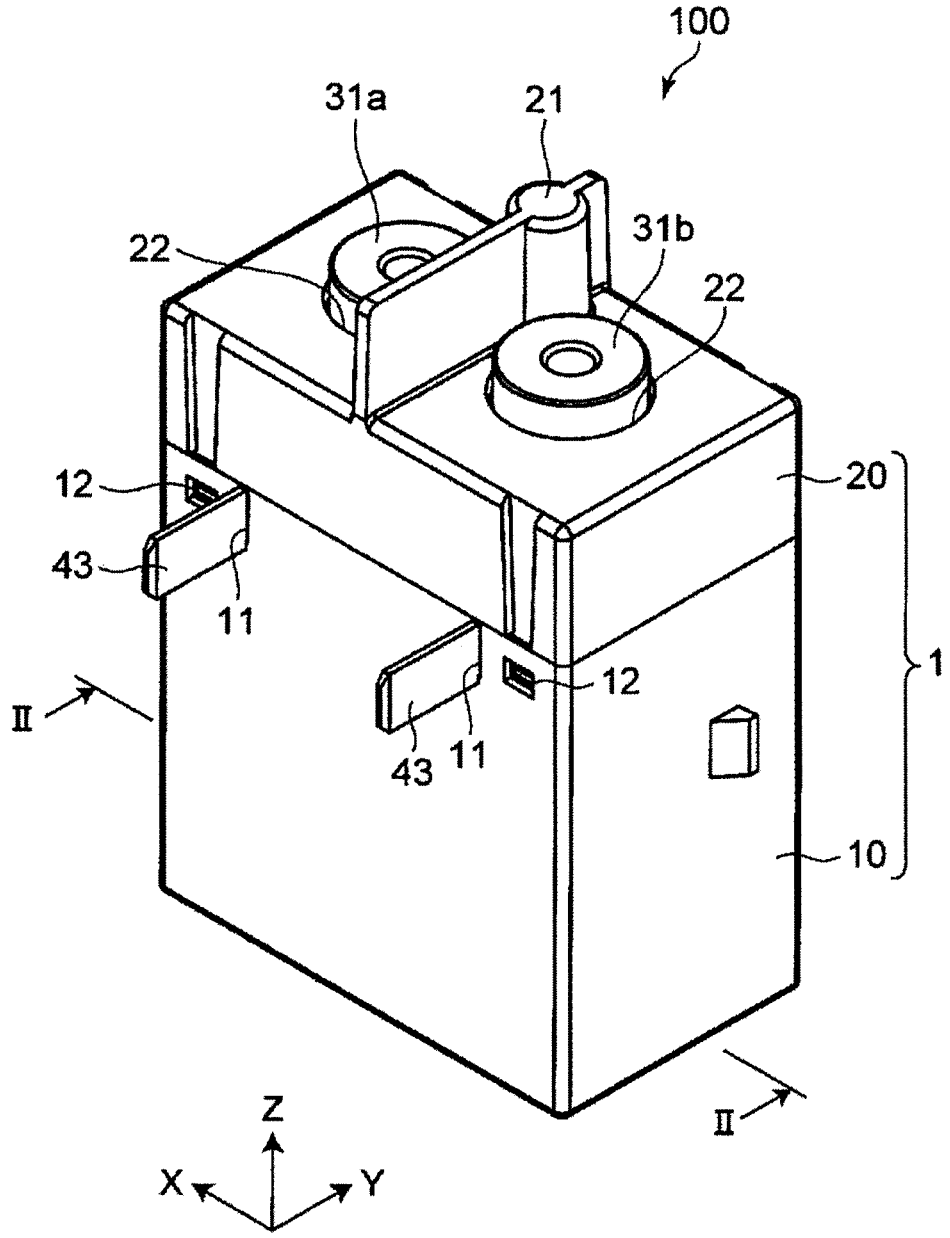
FIG. 1 is a perspective view illustrating an electromagnetic relay of one or more embodiments of the present invention.
Figure 2:
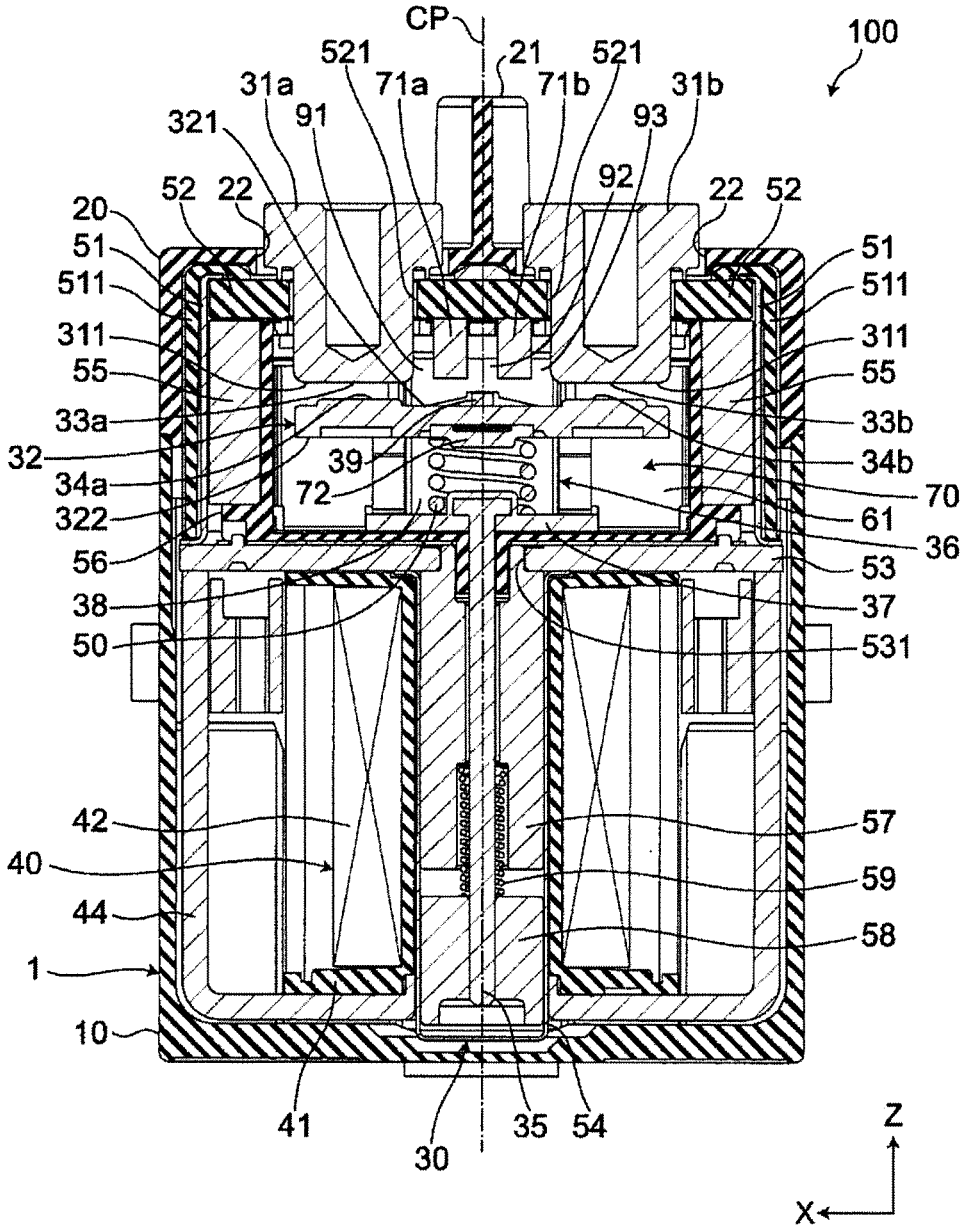
FIG. 2 is a sectional view of the electromagnetic relay of FIG. 1 in a return state taken along line II-II of FIG. 1.
Figure 3:
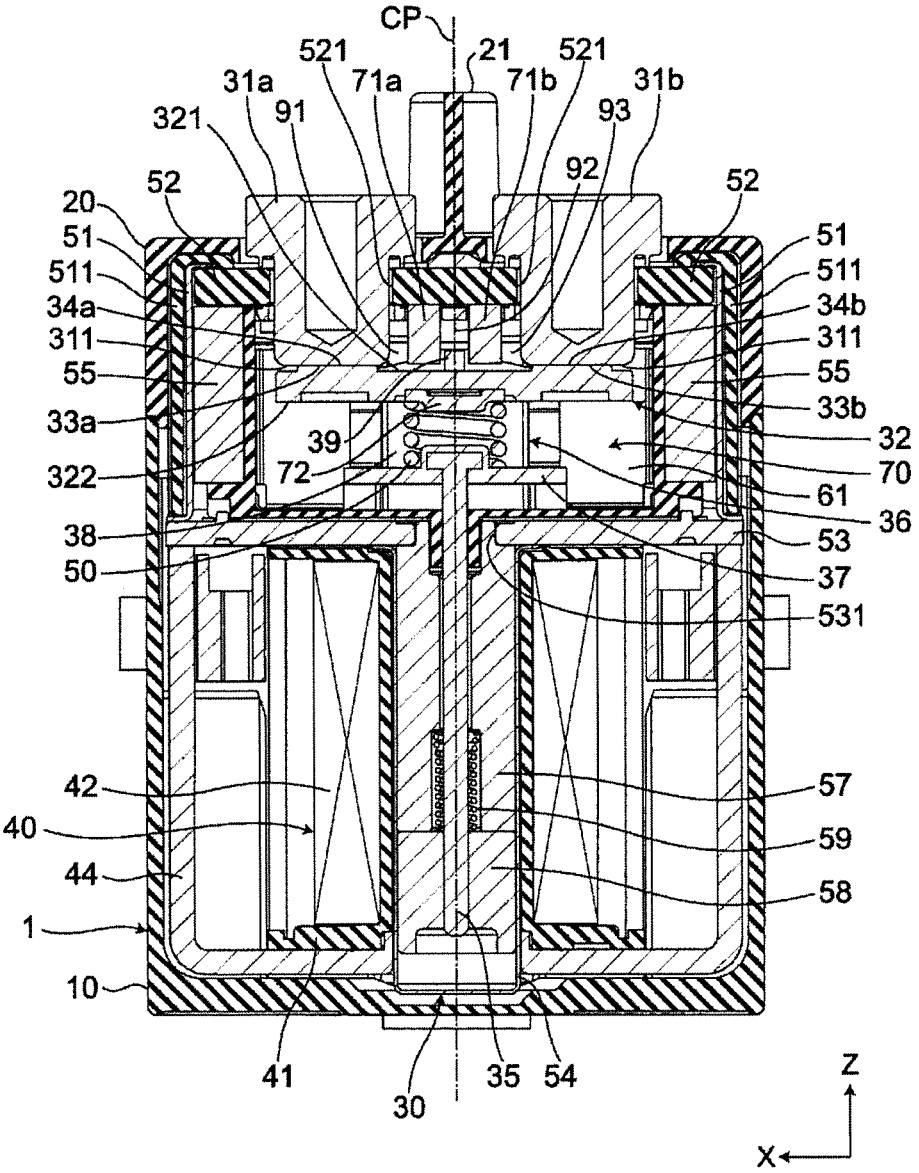
FIG. 3 is a sectional view of the electromagnetic relay of FIG. 1 in an operation state taken along line II-II of FIG. 1.

As illustrated in FIG. 1, an electromagnetic relay 100 of one or more embodiments of the present invention includes an insulating housing 1 and a pair of fixed terminals 31*a*, 31*b* fixed to the housing 1. As illustrated in FIGS. 2 and 3, the electromagnetic relay 100 is symmetrically arranged with respect to a plane CP passing through the centers of the pair of fixed terminals 31*a*, 31*b* and extending in a direction orthogonal to the arrangement direction of the pair of fixed terminals 31*a*, 31*b*.

As illustrated in FIGS. 2 and 3, a closed space 70 is formed inside the housing 1, and the electromagnetic relay 100 includes in the closed space 70 a conductive plate-shaped movable contactor 32 so as to face the pair of fixed terminals 31*a*, 31*b*. Further, the electromagnetic relay 100 includes a pair of fixed contacts 33*a*, 33*b* provided on the pair of fixed terminals 31*a*, 31*b* in the closed space 70, and a pair of movable contacts 34*a*, 34*b* provided on the movable contactor 32 so as to respectively face the pair of fixed contacts 33*a*, 33*b*.

As illustrated in FIGS. 2 and 3, the electromagnetic relay 100 includes two first electromagnetic members 71*a*, 71*b* fixed between the pair of fixed terminals 31*a*, 31*b* of the housing 1, and a second electromagnetic member 72 fixed to the movable contactor 32 so as to face one end (i.e., the lower end in FIG. 2) of each of the first electromagnetic members 71*a*, 71*b*.

Note that an arrangement direction of the pair of fixed terminals 31*a*, 31*b* is defined as an X direction, and a height direction of the electromagnetic relay 100 (i.e., a vertical direction in FIG. 2) is defined as a Z direction. Further, a direction orthogonal to the X and Z directions is defined as a Y direction.

As illustrated in FIGS. 2 and 3, the housing 1 is made up of a case 10, a cover 20, and a closed space forming portion 30 that forms the closed space 70 provided inside the case 10 and the cover 20.

As illustrated in FIG. 1, the case 10 has a rectangular box shape. Further, as illustrated in FIG. 2, the case 10 has an opening on the upper side in the Z direction.

As illustrated in FIG. 1, the side surface of the case 10 in the Y direction is provided with a terminal groove 11 in which a coil terminal 43 protrudes, and a latching hole 12 for fixing the case 10 and the cover 20.

As illustrated in FIG. 1, the cover 20 has a rectangular box shape and is attached so as to cover the opening of the case 10. Further, as illustrated in FIG. 2, the cover 20 has an opening on the lower side in the Z direction.

The upper outer surface of the cover 20 in the Z direction is provided with a partition wall 21 which is provided substantially at the center in the X direction and extends in the Y direction. Terminal holes 22, in which the pair of fixed terminals 31*a*, 31*b* protrude, are respectively provided on both sides of the partition wall 21 in the X direction. Although not illustrated, the opening of the cover 20 is provided with latching pawls for fixing the case 10 and the cover 20 together with the latching holes 12 of the case 10.

As illustrated in FIG. 2, the closed space forming portion 30 is made up of an insulating quadrilateral ceramic plate 52 along an XY plane, a quadrangular cylindrical flange 51 extending downward in the Z direction from the edge of the ceramic plate 52, a plate shaped first yoke 53 disposed at the lower end of the flange 51 along the XY plane, and a circular or square bottomed cylindrical body 54 extending downward in the Z direction from the vicinity of the center portion of the first yoke 53. The flange 51, the ceramic plate 52, and the first yoke 53 are integrated, and the first yoke 53 and the bottomed cylindrical body 54 are joined hermetically.

The flange 51 has an opening at each of the upper and lower ends in the Z direction and has an insulating inner cover 511 covering the outer periphery thereof.

The ceramic plate 52 is disposed so as to close the opening on the upper of the flange 51 in the Z direction. The ceramic plate 52 is provided with a pair of terminal holes 521 arranged so as to face the terminal holes 22 of the cover 20. The pair of fixed terminals 31*a*, 31*b* are inserted into the respective terminal holes 521 and fixed by brazing.

The first yoke 53 is disposed so as to close the lower opening of the flange 51 in the Z direction. A hole portion 531 is provided in the center portion of the first yoke 53. A movable shaft 35 is movably inserted in the hole portion 531.

The flanged bottomed cylindrical body 54 extends from the first yoke 53 to the bottom of the case 10 and is disposed so as to cover the hole portion 531 of the first yoke 53. The bottomed cylindrical body 54 accommodates on the inside the movable shaft 35, a fixed iron core 57 fixed to the first yoke 53, and a movable iron core 58 fixed to the tip (i.e., the lower end in the Z direction) of the movable shaft 35. Between the fixed iron core 57 and the movable iron core 58, a return spring 59 is provided to urge the movable iron core 58 downward in the Z direction.

As illustrated in FIG. 2, each of the pair of fixed terminals 31*a*, 31*b* has a substantially cylindrical shape and is fixed to the ceramic plate 52, constituting the housing 1, electrically independently of each other. The pair of fixed terminals 31*a*, 31*b* are arranged at intervals along a first direction (i.e., the X direction) which is the arrangement direction thereof, and a part of each of the fixed terminals 31*a*, 31*b* is located in the closed space 70.

A fixed contact placement surface 311 along the XY plane is provided on the end face in the closed space 70 of the pair of fixed terminals 31*a*, 31*b* (i.e., the end face at the end of the lower side in the Z direction). Fixed contacts 33*a*, 33*b* are provided on the fixed contact placement surfaces 311, respectively. The respective fixed contacts 33*a*, 33*b* may be formed integrally with the corresponding fixed terminals 31*a*, 31*b*, or may be formed separately from the corresponding fixed terminals 31*a*, 31*b*.

As illustrated in FIG. 2, the movable contactor 32 has a first surface 321 along the XY plane facing the pair of fixed terminals 31*a*, 31*b* and a second surface 322 along the XY plane on opposite side to the first surface 321.

A pair of movable contacts 34*a*, 34*b* are provided on the first surface 321 of the movable contactor 32. That is, the first surface 321 is a movable contact placement surface, and the pair of movable contacts 34*a*, 34*b* are electrically connected to each other by the movable contactor 32. The pair of movable contacts 34*a*, 34*b* are arranged to face the pair of fixed contacts 33*a*, 33*b*, respectively. The movable contacts 34*a*, 34*b* may be formed integrally with the movable contactor 32 or may be formed separately from the movable contactor 32.

As illustrated in FIGS. 2 and 3, a coil spring 50 which expands and contracts along the Z direction and a coil-spring holding portion 36 which holds the coil spring 50 together with the movable contactor 32 are provided below the movable contactor 32 in the Z direction so that the movable contactor 32, the coil spring 50, and the coil-spring holding portion 36 are configured to be integrally movable in the Z direction. The coil-spring holding portion 36 has a support plate portion 37, a pair of support portions 38, and a coupling rod 39.

Figure 5:
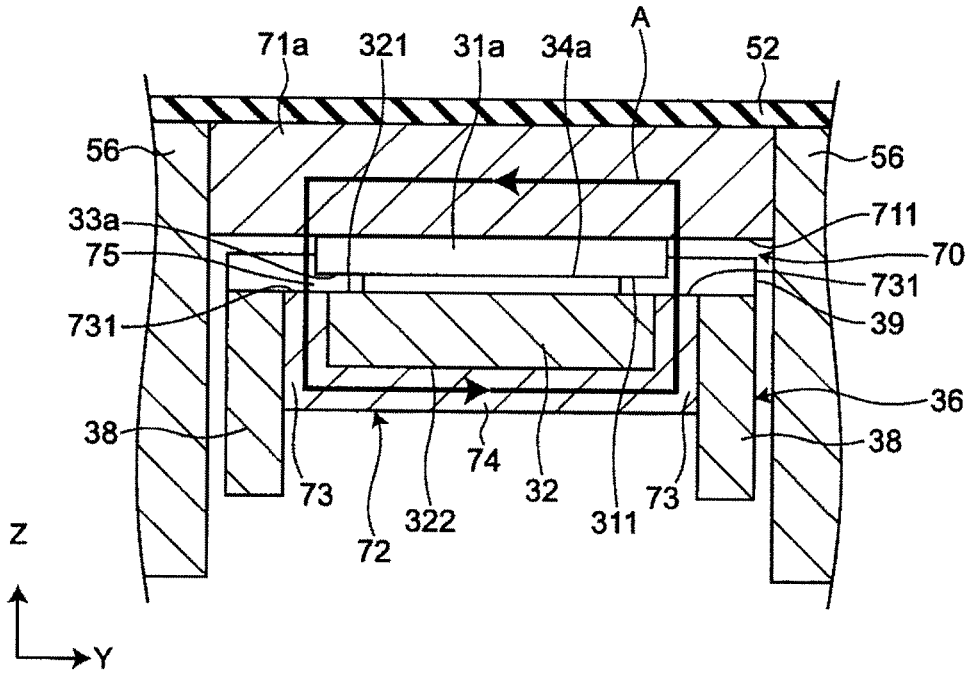
FIG. 5 is a sectional view taken along line V-V of FIG. 4.

The support plate portion 37 sandwiches the coil spring 50 together with the movable contactor 32. The pair of supporting portions 38 respectively extend from both ends facing each other in a second direction (i.e., the Y direction) orthogonal to the first direction (i.e., the X direction) as seen along the Z direction of the support plate portion 37 in a plan view, to both ends of the movable contactor 32 in the Y direction. As illustrated in FIG. 5, each of the pair of support portions 38 is disposed such that each of a pair of facing portions 73 of the second electromagnetic member 72 is located between each of the pair of support portions 38 and the movable contactor 32. Further, the coupling rod 39 is provided on the first surface 321 of the movable contactor 32. The coupling rod 39 is disposed at the center between the pair of movable contacts 34*a*, 34*b* and extends in the second direction (i.e., the Y direction) to couple the pair of supporting portions 38.

An upper end of the movable shaft 35 is integrally fixed to a substantially central portion of the support plate portion 37 so that the support plate portion 37 and the movable shaft 35 are integrally movable in the Z direction. More specifically, the movable shaft 35 extends downward in the Z direction from the support plate portion 37 and is disposed such that a shaft center of the movable shaft 35 coincides with the plane CP in a plan view seen along the Y direction.

Each of the first electromagnetic members 71*a*, 71*b* has a substantially rectangular plate shape and extends parallel to each other along the second direction (i.e., the Y direction) as illustrated in FIG. 5. Each of the first electromagnetic members 71*a*, 71*b* is electrically independent of each other on the inner surface of the ceramic plate 52 constituting the housing 1 on the closed space 70 side and fixed to each of the pair of fixed terminals 31*a*, 31*b* in an electrically independent manner.

That is, a gap 91 is formed between the fixed terminal 31*a* on the left side in the X direction and the first electromagnetic member 71*a* on the left side in the X direction, a gap 92 is formed between the first electromagnetic member 71*a* on the left side in the X direction and the first electromagnetic member 71*b* on the right side in the X direction, and a gap 93 is formed between the first electromagnetic member 71*b* on the right side in the X direction and the fixed terminal 31*b* on the right side in the X direction. As illustrated in FIG. 3, the coupling rod 39 can be inserted into the gap 92.

Further, each of the first electromagnetic members 71*a*, 71*b* is made of a wall member extending from one end to the other end, in the second direction (i.e., Y direction), of the inner surface of the housing 1 forming the closed space 70. In this electromagnetic relay 100, as illustrated in FIG. 5, each of the first electromagnetic members 71*a*, 71*b* is arranged such that both ends thereof in the Y direction are in contact with a magnet holder 56 which will be described later.

As illustrated in FIG. 5, the second electromagnetic member 72 includes the pair of facing portions 73 disposed so as to sandwich the movable contactor 32 in the second direction (i.e., the Y direction) and extending along the first direction (i.e., the X direction), and a coupling portion 74 which is provided on the second surface 322 of the movable contactor 32 and couples the pair of facing portions 73 on the second surface 322 side.

An end face 711 and an end face 731 face each other and a gap 75 is formed therebetween, the end face 711 being each of the first electromagnetic members 71*a*, 71*b* on the movable contactor 32 side (i.e., the lower side of the movable contactor 32 in the Z direction which is the moving direction), the end face 731 being each of the pair of facing portions 73 of the second electromagnetic member 72 on the side of each of the pair of fixed terminals 31*a*, 31*b* (i.e., on the upper side of the movable contactor 32 in the moving direction). Even when the pair of fixed contacts 33*a*, 33*b* and the pair of movable contacts 34*a*, 34*b* come into contact with each other, the gap 75 is always formed without being closed by the respective end faces 711 of the first electromagnetic members 71*a*, 71*b* and the respective end faces 731 of the second electromagnetic member 72.

Figure 4:
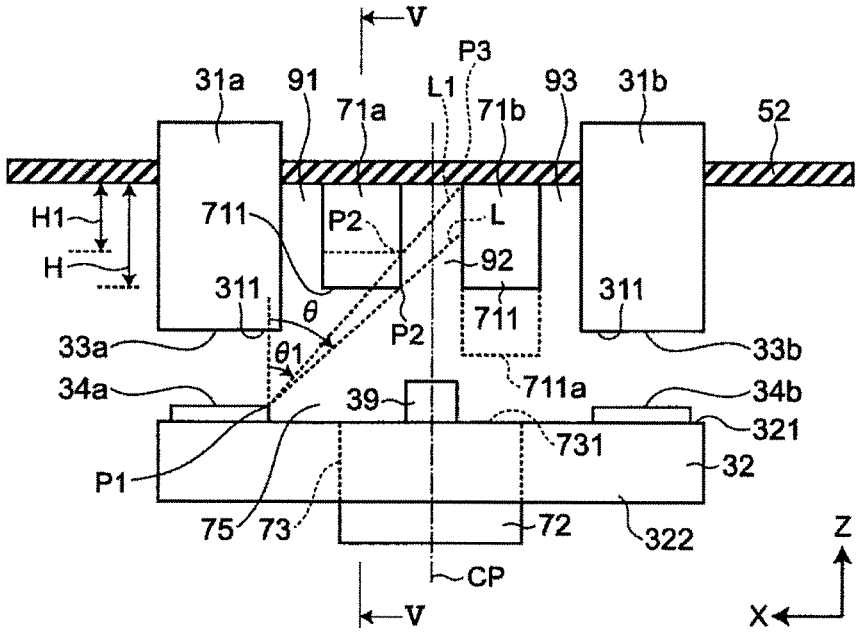
FIG. 4 is a schematic view of a contact mechanism portion in the return state for explaining a first electromagnetic member of the electromagnetic relay of FIG. 1.

The first electromagnetic member 71 preferably has a height H in the Z direction that satisfies the following condition. That is, as illustrated in FIG. 4, in the plan view seen along the second direction (i.e., the Y direction), a straight line connecting an edge P1 and an edge P2 is taken as L, the edge P1 being close to the movable contactor 34*a* of the first electromagnetic member 71, the edge P2 being distant from the movable contactor 34*a* of the end face 711 of the first electromagnetic member 71*a* which is close to the movable contact 34*a*. In this case, in the first electromagnetic member 71*a*, an angle θ formed between a straight line L and the Z axis passing through the edge P1 is preferably larger than an angle θ1 formed by a straight line L1 passing through an intersection P3 of the ceramic plate 52 and the first electromagnetic member 71*b* and the Z axis passing through the edge P1, and a height H of the first electromagnetic member 71*a* is preferably larger than H1.

Generally, at the time of opening and closing a pair of fixed contacts and a pair of movable contacts, the powder of the contact melted by heat of arc scatters (the powder of the scattered contact is hereinafter referred to as scattered powder) associated with contact and separation of the pair of fixed contacts and the pair of movable contacts, the arc being generated between the pair of fixed contacts and the pair of movable contacts. When this scattered powder is accumulated between the pair of fixed terminals 31*a*, 31*b* and the first electromagnetic members 71*a*, 71*b*, a short-circuit path is formed between the pair of fixed terminals 31*a*, 31*b* via a scattered powder having conductivity, thereby causing significant deterioration in insulation between the pair of fixed terminals 31*a*, 31*b*.

By setting the height H of each of the first electromagnetic members 71*a*, 71*b* to be larger than the height H1, it is possible to hinder, with the first electromagnetic members 71*a*, 71*b*, entry of the scattered powder into the gap 92 between the first electromagnetic members 71*a*, 71*b* located in the middle of the gaps between the pair of fixed terminals 31*a*, 31*b*, the scattered powder having been generated with the contact and separation of the pair of fixed contacts 33*a*, 33*b* and the pair of movable contacts 34*a*, 34*b*. As a result, it is possible to prevent accumulation of the scattered powder in the gap 92. In other words, the first electromagnetic members 71*a*, 71*b* can prevent accumulation of the scattered powder on the ceramic plate 52 in the gap 93 between the pair of fixed terminals 31*a*, 31*b*, so as to more reliably avoid formation of a short-circuit path between the pair of fixed terminals 31*a*, 31*b*.

A pair of permanent magnets 55, 55 and an arc shielding member 61 are provided in the closed space inside the flange 51.

The pair of permanent magnets 55, 55 face each other and are disposed at both ends in the X direction inside the flange 51 so as to sandwich the pair of fixed contacts 33*a*, 33*b* and the pair of movable contacts 34*a*, 34*b*. An insulating magnet holder 56 holds the pair of permanent magnets 55, 55. The magnet holder 56 extends to the movable shaft 35 along the upper surface of the first yoke 53 in the Z direction.

As illustrated in FIGS. 2 and 3, the arc shielding member 61 is disposed so as to cover both sides of the pair of fixed contacts 33*a*, 33*b* and the pair of movable contacts 34*a*, 34*b* in the Y direction (the back side and the front side in FIG. 2), and the outside (the sides closer to the adjacent permanent magnets 55) thereof in the X direction.

As illustrated in FIG. 2, an electromagnet portion 40 is made up of an insulating spool 41, a coil 42 wound around the spool 41, and a coil terminal 43 (illustrated in FIG. 1) fixed to the spool 41. By applying a voltage to the coil 42, the electromagnet portion 40 moves the movable shaft 35 up and down along the Z direction to cause the movable contactor 32 approach or separate from the fixed contact placement surfaces 311 of the pair of fixed terminals 31*a*, 31*b*.

Inside the housing 1, a second yoke 44 having a substantially U-shaped in a cross section is provided. The second yoke 44 is connected to the first yoke 53 and disposed inside the case 10 so as to surround the electromagnet portion 40 together with the first yoke 53.

Next, the operation of the electromagnetic relay 100 will be described with reference to FIGS. 2 and 3. FIG. 2 illustrates the electromagnetic relay 100 in a return state, and FIG. 3 illustrates the electromagnetic relay 100 in an operation state.

In the electromagnetic relay 100 in the return state in which no voltage is applied to the coil 42 of the electromagnet section 40, as illustrated in FIG. 2, the movable iron core 58 fixed to the tip of the movable shaft 35 is urged downward in the Z direction by the return spring 59, and the pair of fixed terminals 31*a*, 31*b* and the pair of movable contacts 34*a*, 34*b* are separated from each other.

When a voltage is applied to the coil 42 of the electromagnetic relay 100 in the return state illustrated in FIG. 2, the movable iron core 58 is magnetically attracted to the fixed iron core 57 and moves upward in the Z direction against the spring force of the return spring 59. As the movable iron core 58 moves, the movable shaft 35 moves upward in the Z direction to move the movable contactor 32 upward in the Z direction via the coil spring 50, and the first surface 321 of the movable contactor 32 approaches the pair of fixed terminals 31*a*, 31*b*. As illustrated in FIG. 3, as the movable contactor 32 approaches the pair of fixed terminals 31*a*, 31*b*, the pair of movable contacts 34*a*, 34*b* provided on the first surface 321 of the movable contactor 32 respectively come into contact with the pair of fixed contacts 33*a*, 33*b*.

At this time, for example, when a current flows from the left side to the right side in the X direction on the movable contactor 32, a magnetic flux in the direction indicated by an arrow A in FIG. 5 is formed, so and a magnetic attractive force acts between the first electromagnetic members 71*a*, 71*b* and the second electromagnetic member 72. This magnetic attractive force acts in a direction canceling off the electromagnetic repulsive force generated between the pair of fixed contacts 33*a*, 33*b* and the pair of movable contacts 34*a*, 34*b*. It is thereby possible to ensure the contact reliability between the pair of fixed contacts 33*a*, 33*b* and the pair of movable contacts 34*a*, 34*b*.

A gap 75 is always formed between each end face 711 on the lower side of each of the first electromagnetic members 71*a*, 71*b* in the movement direction (i.e., the Z direction) of the movable contactor 32 and each end face 731 on the upper side, in the moving direction, of each of the pair of facing portions 73 of the second electromagnetic member 72. Adjusting the interval of the gap 75 makes it possible to adjust the magnetic attractive force acting between the first electromagnetic members 71*a*, 71*b* and the second electromagnetic member 72. That is, decreasing the gap 75 enables an increase in magnetic attractive force acting between the first electromagnetic members 71*a*, 71*b* and the second electromagnetic member 72, and increasing the gap 75 enables a decrease in magnetic attractive force acting between the first electromagnetic members 71*a*, 71*b* and the second electromagnetic member 72

When the application of the voltage to the coil 42 of the electromagnetic relay 100 in the operation state illustrated in FIG. 3 is stopped, the magnetic attractive force of the fixed iron core disappears and the movable iron core 58 moves downward in the Z direction due to the spring force of the return spring 59. The movable shaft 35 moves toward the lower side in the Z direction with the movement of the movable iron core 58, the movable contactor 32 is moved downward in the Z direction via the coil spring 50, and the first surface 321 of the movable contactor 32 are separated from the pair of fixed terminals 31*a*, 31*b*. As illustrated in FIG. 2, as the movable contactor 32 separates from the pair of fixed terminals 31*a*, 31*b*, the pair of movable contacts 34*a*, 34*b* provided on the first surface 321 of the movable contactor 32 are separated from the pair of fixed contacts 33*a*, 33*b*, respectively.

That is, the movable contactor 32 is movably disposed such that the first surface 321 approaches and separates from the pair of fixed terminals 31*a*, 31*b*. As illustrated in FIG. 2, the pair of movable contacts 34*a*, 34*b* are disposed so as to respectively separate from the pair of fixed contacts 33*a*, 33*b* as the movable contactor 32 separates from the pair of fixed terminals 31*a*, 31*b*. Further, as illustrated in FIG. 3, the pair of movable contacts 34*a*, 34*b* are disposed so as to respectively contact the pair of fixed contacts 33*a*, 33*b* as the movable contactor 32 approaches the pair of fixed terminals 31*a*, 31*b*.

According to the electromagnetic relay 100 of one or more embodiments of the present invention, between the fixed terminals 31*a*, 31*b* of the housing 1, the plurality of first electromagnetic members 71*a*, 71*b* are provided which are disposed electrically independently of each other, with the gap 92 formed therebetween in the arrangement direction of the pair of fixed terminals 31*a*, 31*b*, between the pair of fixed terminals 31*a*, 31*b* of the housing 1 and are fixed to the pair of fixed terminals 31*a*, 31*b* in an electrically independent manner. It is thereby possible to avoid formation of a short-circuit path between the pair of fixed terminals 31*a*, 31*b* due to the scattered powder and to ensure the insulation between the pair of fixed terminals 31*a*, 31*b*.

Further, each of the first electromagnetic members 71*a*, 71*b* is made of a wall member extending from one end to the other end, in the second direction, of the inner surface of the housing 1 forming the closed space 70. This enables prevention of the scattered powder from entering the gap 92 between the first electromagnetic members 71*a*, 71*b*, so that it is possible to more reliably avoid accumulation of the scattered powder and formation of a short-circuit path between the pair of fixed terminals 31*a*, 31*b* due to the scattered powder and to ensure the insulation between the pair of fixed terminals 31*a*, 31*b*.

In addition, the coupling rod 39 of the coil-spring holding portion 36 can be inserted into the gap 92 between the first electromagnetic members 71*a*, 71*b*. This facilitates adjustment of the gap 75 between each of the first electromagnetic members 71*a*, 71*b* and the second electromagnetic member 72, so that it is possible to easily adjust the magnetic attractive force acting between the each of first electromagnetic members 71*a*, 71*b* and the second electromagnetic member 72.

In the electromagnetic relay 100 according to one or more embodiments of the present invention, the end face 711 at one end of each first electromagnetic members 71*a*, 71*b* is provided so as to be located at a position more distant from the movable contactor 32 than each of the pair of fixed contacts 33*a*, 33*b*, but this is not restrictive. For example, as illustrated in FIG. 4, the first electromagnetic members 71*a*, 71*b* may have an end face 711*a* located between the pair of fixed contacts 33*a*, 33*b* and the movable contactor 32. This enables prevention of the scattered powder from entering the gap 92 between the first electromagnetic members 71*a*, 71*b*, so that it is possible to more reliably avoid accumulation of the scattered powder and formation of a short-circuit path between the pair of fixed terminals 31*a*, 31*b* due to the scattered powder and to ensure the insulation between the pair of fixed terminals 31*a*, 31*b*.

Further, if possible, the closed space may be a space not closed or may be a sealed space.

The number of the first electromagnetic members 71*a*, 71*b* may be plural, not limited to two, but three or more may be provided. At this time, at least one gap may only be provided between the first electromagnetic members.

Further, the first electromagnetic members 71*a*, 71*b* are not limited to the case of being disposed in parallel with each other. The first electromagnetic members can be arranged in a freely selected manner as long as having a gap in the first direction which is the arrangement direction between the pair of fixed terminals.

A variety of embodiments of the present invention have been described in detail with reference to the drawings, and lastly, a variety of aspects of the present invention will be described.

An electromagnetic relay of a first aspect of the present invention is an electromagnetic relay including: a box-shaped insulating housing in which a closed space is formed; a pair of fixed terminals fixed to the housing electrically independently of each other and each having a fixed contact placement surface in the closed space; a plate-shaped conductive movable contactor which is provided in the closed space, has a first surface facing the fixed contact placement surfaces of the pair of fixed terminals, and is movably disposed such that the first surface approaches and separates from the fixed contact placement surfaces of the pair of fixed terminals; a pair of fixed contacts respectively provided on the fixed contact placement surfaces of the pair of fixed terminals; a pair of movable contacts which respectively provided on the first surface of the movable contactor and which respectively face the pair of fixed contacts, respectively come into contact with the pair of fixed contacts with approach of the movable contactor to the pair of fixed terminals, and is disposed so as to respectively separate from the pair of fixed contacts with separation of the movable contactor from the pair of fixed terminals; a plurality of first electromagnetic members which are disposed electrically independently of each other, with a gap provided therebetween in a first direction that is an arrangement direction of the pair of fixed terminals, between the pair of fixed terminals in the housing, are fixed to the pair of fixed terminals in an electrically independent manner; and which extend in a second direction orthogonal to the first direction in a plan view seen along a moving direction of the movable contactor; and a second electromagnetic member which includes a pair of facing portions disposed so as to sandwich the movable contactor in the second direction and extending along the first direction, and a coupling portion fixed to a second surface on an opposite side of the movable contactor from the first surface and configured to couple the pair of facing portions on the second surface side, the second electromagnetic member being configured such that the pair of facing portions face respective one ends of the plurality of first electromagnetic members on the movable contactor side in the moving direction, and a gap is provided between the second electromagnetic member and the one ends of the plurality of first electromagnetic members when the pair of movable contacts respectively come into contact with the pair of fixed contacts.

According to the electromagnetic relay of the first aspect, with the plurality of first electromagnetic members provided, it is possible to avoid formation of a short-circuit path between a pair of fixed terminals due to a scattered powder and ensure the insulation between the pair of fixed terminals and the plurality of first electromagnetic members being disposed electrically independently of each other, with a gap provided therebetween in the arrangement direction of the pair of fixed terminals, between the pair of fixed terminals in the housing and being fixed to the pair of fixed terminals in an electrically independent manner.

In an electromagnetic relay of a second aspect of the present invention, each of the plurality of first electromagnetic members is made of a wall member extending from one end to the other end, in the second direction, of an inner surface of the housing forming the closed space.

According to the electromagnetic relay of the second aspect, the accumulation of the scattered powder in the gap between the first electromagnetic members can be prevented, so that it is possible to more reliably avoid formation of a short-circuit path between the pair of fixed terminals due to the scattered powder and to ensure the insulation.

In an electromagnetic relay of a third aspect of the present invention, the respective ends of the plurality of first electromagnetic members are located between the pair of fixed contacts and the movable contactor in the approaching and separating direction.

According to the electromagnetic relay of the third aspect, the accumulation of the scattered powder in the gap between the first electromagnetic members can be prevented, so that it is possible to avoid formation of a short-circuit path between the pair of fixed terminals due to the scattered powder and to ensure the insulation.

An electromagnetic relay of a fourth aspect of the present invention further includes a coil spring that comes into contact with the second surface of the movable contactor and expands and contracts along the approaching and separating direction of the movable contactor; and a coil-spring holding portion that includes a support plate portion configured to sandwich the coil spring together with the movable contactor, a pair of support portions that extend from both ends of the support plate portion facing each other in the second direction to both ends of the movable contactor in the second direction and are disposed such that each of the pair of facing portions of the second electromagnetic member is located between each of the pair of support portions and the movable contactor and a coupling rod provided on the first surface of the movable contactor and extending in the second direction to be coupled to the pair of support portions, and the coupling rod is provided so as to be insertable into the gap between the plurality of first electromagnetic members.

According to the electromagnetic relay of the fourth aspect, the adjustment of the gap between each of the first electromagnetic members and the second electromagnetic member is facilitated, so that it is possible to easily adjust the magnetic attractive force acting between the each of first electromagnetic members and the second electromagnetic member.

By appropriately combining freely selected embodiments or modified examples of the above variety of embodiments or modified examples, the respective effects of those combined can be exerted. While it is possible to combine embodiments, combine examples, or combine an embodiment and an example, it is also possible to combine features in different embodiments or examples.

While the present invention has been fully described in connection with the embodiments with reference to the accompanying drawings, a variety of modified examples or corrections will be apparent to those skilled in the art. Such modifications or amendments are to be understood as being included in the scope of the present invention according to the appended claims so long as not deviating therefrom.

The electromagnetic relay according to one or more embodiments of the present invention is not limited to the above embodiment, but can be applied to other electromagnetic relays.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

1 housing
10 case
11 terminal groove
12 latching hole
20 cover
21 partition wall
22 terminal hole
30 closed space forming portion
31*a*, 31*b* fixed terminal
311 fixed contact placement surface
32 movable contactor
321 first surface
322 second surface
33*a*, 33*b* fixed contact
34*a*, 34*b* movable contact
35 movable shaft
36 coil-spring holding portion
37 support plate portion
38 support portion
39 coupling rod
40 electromagnet portion
41 spool
42 coil
43 coil terminal
44 second yoke
50 coil spring
51 flange
52 ceramic plate
521 terminal hole
53 first yoke
531 hole
54 bottomed cylindrical body
55 permanent magnet
56 magnet holder
57 fixed iron core
58 movable iron core
59 return spring
61 arc shielding member
70 closed space
71*a*, 71*b* first electromagnetic member
711 end face
72 second electromagnetic member
73 facing portion
731 end face
74 coupling portion
75 gap
91, 92, 93 gap
100 electromagnetic relay
H height of first electromagnetic member
P1 edge of movable contactor close to first electromagnetic member
P2 edge distant from movable contactor on end face of first electromagnetic member close to movable contact
P3 intersection of ceramic plate and first electromagnetic member
L straight line connecting P1 and P2
θ angle formed by straight line L and Z axis
A magnetic flux

The invention claimed is:

1. An electromagnetic relay comprising:

a box-shaped insulating housing in which a closed space is formed;

a pair of fixed terminals fixed to the housing electrically independently of each other and each having a fixed contact placement surface in the closed space;

a plate-shaped conductive movable contactor that:

is provided in the closed space, has a first surface facing the fixed contact placement surfaces of the pair of fixed terminals, and is movably disposed such that the first surface approaches and separates from the fixed contact placement surfaces of the pair of fixed terminals;

a pair of fixed contacts respectively provided on the fixed contact placement surfaces of the pair of fixed terminals;

a pair of movable contacts that:

is respectively provided on the first surface of the movable contactor and respectively face the pair of fixed contacts, is respectively come into contact with the pair of fixed contacts with approach of the movable contactor to the pair of fixed terminals, and is disposed so as to respectively separate from the pair of fixed contacts with separation of the movable contactor from the pair of fixed terminals;

a plurality of first electromagnetic members that:

are disposed electrically independently of each other, with a gap provided therebetween in a first direction that is an arrangement direction of the pair of fixed terminals, between the pair of fixed terminals in the housing, are fixed to the pair of fixed terminals electrically independently, and extend in a second direction orthogonal to the first direction in a plan view seen along a moving direction of the movable contactor; and a second electromagnetic member comprising:

a pair of facing portions disposed so as to sandwich the movable contactor in the second direction and extending along the first direction, and a coupling portion fixed to a second surface on an opposite side of the movable contactor from the first surface and configured to couple the pair of facing portions on the second surface side, wherein the second electromagnetic member is configured such that:

the pair of facing portions face respective one ends of the plurality of first electromagnetic members on the movable contactor side in the moving direction, and a gap is provided between the second electromagnetic member and the one ends of the plurality of first electromagnetic members when the pair of movable contacts respectively come into contact with the pair of fixed contacts.

2. The electromagnetic relay according to claim 1, wherein each of the plurality of first electromagnetic members is made of a wall member extending from one end to the other end, in the second direction, of an inner surface of the housing forming the closed space.

3. The electromagnetic relay according to claim 2, wherein the respective ends of the plurality of first electromagnetic members are located between the pair of fixed contacts and the movable contactor in the moving direction of the movable contactor.

4. The electromagnetic relay according to claim 2, further comprising:

a coil spring that comes into contact with the second surface of the movable contactor and expands and contracts along the moving direction of the movable contactor; and a coil-spring holding portion comprising:

a support plate portion configured to sandwich the coil spring together with the movable contactor, a pair of support portions that extend from both ends of the support plate portion facing each other in the second direction to both ends of the movable contactor in the second direction and are disposed such that each of the pair of facing portions of the second electromagnetic member is located between each of the pair of support portions and the movable contactor, and a coupling rod provided on the first surface of the movable contactor and extending in the second direction to be coupled to the pair of support portions, wherein the coupling rod is provided so as to be insertable into the gap between the plurality of first electromagnetic members.

5. The electromagnetic relay according to claim 1, wherein the respective ends of the plurality of first electromagnetic members are located between the pair of fixed contacts and the movable contactor in the moving direction of the movable contactor.

6. The electromagnetic relay according to claim 5, further comprising:

a coil spring that comes into contact with the second surface of the movable contactor and expands and contracts along the moving direction of the movable contactor; and a coil-spring holding portion comprising:

a support plate portion configured to sandwich the coil spring together with the movable contactor, a pair of support portions that extend from both ends of the support plate portion facing each other in the second direction to both ends of the movable contactor in the second direction and are disposed such that each of the pair of facing portions of the second electromagnetic member is located between each of the pair of support portions and the movable contactor, and a coupling rod provided on the first surface of the movable contactor and extending in the second direction to be coupled to the pair of support portions, wherein the coupling rod is provided so as to be insertable into the gap between the plurality of first electromagnetic members.

7. The electromagnetic relay according to claim 1, further comprising:

a coil spring that comes into contact with the second surface of the movable contactor and expands and contracts along the moving direction of the movable contactor; and a coil-spring holding portion comprising:

a support plate portion configured to sandwich the coil spring together with the movable contactor, a pair of support portions that extend from both ends of the support plate portion facing each other in the second direction to both ends of the movable contactor in the second direction and are disposed such that each of the pair of facing portions of the second electromagnetic member is located between each of the pair of support portions and the movable contactor, and a coupling rod provided on the first surface of the movable contactor and extending in the second direction to be coupled to the pair of support portions, wherein the coupling rod is provided so as to be insertable into the gap between the plurality of first electromagnetic members.

* * * * *